US008976984B2

(12) United States Patent
Akino

(10) Patent No.: US 8,976,984 B2
(45) Date of Patent: Mar. 10, 2015

(54) DYNAMIC MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 460 days.

(21) Appl. No.: 13/566,454

(22) Filed: Aug. 3, 2012

(65) Prior Publication Data

US 2013/0070941 A1 Mar. 21, 2013

(30) Foreign Application Priority Data

Aug. 19, 2011 (JP) ..... 2011-179412

(51) Int. Cl.
*H04R 3/00* (2006.01)
*H04R 9/02* (2006.01)
*H04R 9/08* (2006.01)

(52) U.S. Cl.
CPC . *H04R 9/025* (2013.01); *H04R 9/08* (2013.01)
USPC ..... 381/122; 381/177; 381/412; 381/355; 381/111; 381/375; 381/91

(58) Field of Classification Search
CPC ..... H04R 9/08; H04R 1/083; H04R 9/025; H04R 19/04; H04R 1/04; H04R 1/2807; H04R 2410/00; H04R 9/04
USPC ..... 381/122, 177, 412, 355, 111, 375, 91
See application file for complete search history.

(56) References Cited

U.S. PATENT DOCUMENTS

2005/0276428 A1* 12/2005 Akino ..... 381/170

FOREIGN PATENT DOCUMENTS

JP 2000-253490 A 9/2000
JP 2005-354571 12/2005

OTHER PUBLICATIONS

Japan Patent Office, "Office Action for JP 2011-179412," Sep. 12, 2014.

* cited by examiner

*Primary Examiner* — Paul S Kim
(74) *Attorney, Agent, or Firm* — Manabu Kanesaka

(57) ABSTRACT

A microphone includes a polar piece contacting with a first magnetic pole of a first permanent magnet, a yoke body annularly arranged around the polar piece through a magnetic gap G with a predetermined width, a magnetic circuit unit including a tail yoke connected to the yoke body and contacting with a second magnetic pole of the first permanent magnet, and a diaphragm unit provided with a voice coil arranged to vibrate in the magnetic gap. The second magnetic pole of the first permanent magnet contacts with one side of the tail yoke, a first magnetic pole of the second permanent magnet is disposed to contact with other side of the tail yoke, a magnetic path is produced between the second magnetic pole of the second permanent magnet and the yoke body, and the first permanent magnet and the second permanent magnet are polarized in the same sense.

6 Claims, 2 Drawing Sheets

DYNAMIC MICROPHONE

BACKGROUND OF THE INVENTION

1. Field of the Invention

The present invention relates to a dynamic microphone and more particularly to a dynamic microphone in which a flux density in a magnetic gap where a voice coil is disposed is increased to improve sensitivity.

2. Description of the Related Art

A dynamic microphone is arranged such that a voice coil attached to a diaphragm is disposed in a magnetic gap formed in a magnetic circuit so that vibration of the diaphragm generates electric current in the voice coil, and therefore called an electro-dynamic microphone as well.

FIG. 3 shows in section an example of a conventional dynamic microphone. Reference numeral 1 indicates a magnetic circuit unit. A cylindrical permanent magnet (magnet) 2 is provided in the center of this magnetic circuit unit 1. A disk-shaped polar piece 3 is arranged in contact with one magnetic pole (for example, north(N) pole) of this permanent magnet 2. Further, a disk-shaped tail yoke 4 is arranged in contact with the other pole (for example, south (S) pole) of the above-mentioned permanent magnet 2. This tail yoke 4 is attached to a cylindrically shaped yoke body 5 to be fitted therein.

A ring-shaped magnetic gap G is formed between a perimeter face of the above-mentioned polar piece 3 and an inner circumference face at the front end of the cylindrical yoke body 5, thus constituting the above-mentioned magnetic circuit unit 1.

Further, reference numeral 11 indicates a diaphragm unit, in which a diaphragm 12 is constituted by a center dome 12*a* and a sub-dome 12*b* that is formed integrally with and around the center dome 12*a*. A voice coil 13 is integrally fixed to the diaphragm 12 using an adhesive (for example) at the boundary between the center dome 12*a* and the sub-dome 12*b* at the back of the diaphragm 12.

Furthermore, a circumferential edge of the sub-dome 12*b* which constitutes the diaphragm 12 is attached to the front end of a cylinder member 21 fitted onto the outside of the above-mentioned yoke body 5. In this situation, the above-mentioned voice coil 13 is arranged in the above-mentioned magnetic gap G.

In addition, reference numeral 23 indicates a resonator arranged in front of the diaphragm unit 11 through the above-mentioned cylinder member 21. Further, reference numeral 25 indicates a cap member in which a through hole 25*a* is formed in the center. This cap member 25 within which an acoustic resister 27 is arranged is attached to and fitted into the back end of the cylindrically shaped yoke body 5.

Incidentally, sensitivity of the thus arranged dynamic microphone generally depends on flux density in the above-mentioned magnetic gap G, length of the above-mentioned voice coil 13, and velocity of the voice coil 13 when the diaphragm 12 receives a sound wave.

Of these, the flux density in the magnetic gap G can be increased by narrowing the gap width. There is, however, a limit to reduction of the width of the magnetic gap G naturally, since the voice coil 13 is disposed within the magnetic gap so as to vibrate.

Further, in view of restrictions on a gap volume in the magnetic gap G and output impedance, it is hard to increase the length of the voice coil 13. Thus, it is often designed to have an impedance of 600Ω or less.

Furthermore, since the velocity of the voice coil 13 depends on the design of the acoustic mechanical vibration of the microphone unit, it is undesirable to increase the velocity taking into consideration the general directional frequency response.

Thus, the present applicant previously proposed the arrangement shown in FIG. 4 as a further improvement in the sensitivity of the dynamicmicrophone . This is disclosed in Japanese Patent No. 4573576. It should be noted that, in FIG. 4, parts which function similarly to those illustrated in FIG. 3 above are denoted by the same reference signs. Accordingly, the description of these parts will not be repeated herein.

The improvement shown in FIG. 4 arises having regard to considerable flux leakage taking place in the magnetic gap G in the magnetic circuit unit 1. By controlling the flux leakage in the magnetic gap portion, flux density in the magnetic gap is increased and the sensitivity of the microphone is improved.

Thus, as shown in FIG. 4, in the position opposed to the above-mentioned polar piece 3 and in front of the resonator 23, a second permanent magnet 31 is disposed to face the above-mentioned permanent magnet 2 and polarized so that both the facing sides have the same pole.

In other words, assuming that the polar piece 3 side of the above-mentioned permanent magnet 2 is polarized to have north(N) pole, the polar piece 3 side of the second permanent magnet 31 is also polarized to have north(N) pole.

According to the above-described arrangement, a loop of magnetic flux produced by the second-permanent magnet 31 and directed from north (N) pole to south (S) pole runs very close to the above-mentioned magnetic gap G, and this loop of magnetic flux acts so that the magnetic flux produced by the permanent magnet 2 and going to leak at the above-mentioned magnetic gap G may be pushed back to the magnetic gap G side.

As a result, the density of the magnetic flux produced by the permanent magnet 2 can be increased at the magnetic gap G and the sensitivity of the microphone can be improved.

Incidentally, in this type of dynamic microphone or speaker, it is known that using a molded magnet (alnico) as a permanent magnet for that magnetic circuit provides better sound quality than using a sintered alloy (ferrite, samarium cobalt, neodymium).

As compared with the samarium cobalt magnet or the neodymium magnet, the alnico magnet provides low magnetic energy and a microphone using the alnico magnet provides low magnetic energy as compared with that using the neodymium magnet, so that sensitivity of the microphone is low.

Then, as shown in FIG. 4, the second permanent magnet 31 is disposed to face the permanent magnet 2 and polarized so that both the facing sides have the same pole. It is envisaged that, in order to improve sound quality, the alnico magnet is used as the permanent magnet 2 which provides a magnetic field to the voice coil and the neodymium magnet having a large amount of magnetic energy is used as the second permanent magnet 31 for suppressing magnetic leakage in the magnetic gap. However, in the case of combining the above-mentioned magnets, a problem arises in that the permanent magnet 2 made of alnico is likely to be demagnetized by the second permanent magnet 31 made of neodymium.

Furthermore, according to the structure shown in FIG. 4, since it is arranged that the second permanent magnet 31 is disposed in front of the diaphragm, there is a limit to designing the above-mentioned resonator which is a cover member for improving high-frequency response of the dynamic microphone and a front sound terminal of the microphone. In other words, the dynamic microphone without having the second permanent magnet in front of the diaphragm can be designed to improve high-frequency response characteristics.

SUMMARY OF THE INVENTION

The present invention arises from the technical viewpoint as described above and aims to providing a dynamic microphone which can alleviate a problem with demagnetization of a permanent magnet for providing a magnetic field to a voice coil, increase flux density in a magnetic gap, improve sensitivity further, and also improve high-frequency response characteristics.

The dynamic microphone in accordance with the present invention made in order to solve the above-mentioned problems is a dynamic microphone, having a polar piece which is in contact with a first magnetic pole of a first permanent magnet, a yoke body annularly arranged around the above-mentioned polar piece through a magnetic gap with a predetermined width, a magnetic circuit unit including a tail yoke which is connected to the above-mentioned yoke body and in contact with a second magnetic pole of the above-mentioned first permanent magnet, and a diaphragm unit provided with a voice coil arranged to vibrate in the above-mentioned magnetic gap, wherein the second magnetic pole of the above-mentioned first permanent magnet is in contact with one side of the above-mentioned tail yoke, a first magnetic pole of a second permanent magnet is disposed in contact with the other side of the above-mentioned tail yoke, a magnetic path is produced between a second magnetic pole of the above-mentioned second permanent magnet and the above-mentioned yoke body, and the above-mentioned first permanent magnet and the above-mentioned second permanent magnet are polarized in the same sense.

In this case, it is desirable that the second polar piece is further disposed in contact with the second magnetic pole of the above-mentioned second permanent magnet and the magnetic path is produced between the second magnetic pole of the above-mentioned second permanent magnet and the above-mentioned yoke body through the above-mentioned second polar piece.

Thereby, the magnetic path is produced between the second magnetic pole of the above-mentioned second permanent magnet and the above-mentioned yoke body through the second polar piece.

In addition, the above-mentioned first permanent magnet and the above-mentioned second permanent magnet are made of different materials, and the above-mentioned first permanent magnet and the above-mentioned second permanent magnet different in magnetic energy are used.

In this case, it is preferable that an alnico magnet is used as the above-mentioned first permanent magnet and a neodymium magnet is used as the above-mentioned second permanent magnet.

According to the dynamic microphone with the structure as described above, the second magnetic pole of the first permanent magnet which is in contact with one side of the tail yoke, the second permanent magnet is disposed on the other side (the opposite side) of the tail yoke, and the above-mentioned first permanent magnet and the above-mentioned second permanent magnet are polarized in the same sense, so that the magnetic flux produced by the above-mentioned first permanent magnet is added to the magnetic flux produced by the above-mentioned second permanent magnet at the magnetic gap between the polar piece and the yoke. Thus, the flux density of the above-mentioned magnetic gap can be increased, and the sensitivity of the dynamicmicrophone can be further improved.

Further, since the first permanent magnet and second permanent magnet are polarized in the same sense, it is possible to alleviate the above-mentioned problem that the first permanent magnet which mainly provides the magnetic field to the voice coil is demagnetized by the second permanent magnet.

Furthermore, by using the alnico magnet as the first permanent magnet and using the neodymium magnet as the above-mentioned second permanent magnet, it is possible to provide the dynamic microphone which demonstrates each property, with regard to improvement in the sound quality due to the use of the alnico magnet and improvement in the sensitivity due to the use of the neodymium magnet with considerable magnetic energy.

DESCRIPTION OF THE PREFERRED EMBODIMENTS

A dynamic microphone in accordance with the present invention will be described with reference to a sectional view showing an internal structure illustrated in FIG. 1 and a schematic diagram of a magnetic circuit shown in FIG. 2. It should be noted that, in FIG. 1, parts which function similarly to those illustrated in FIG. 3 above are denoted by the same reference signs. Accordingly, the description of these parts will not be repeated herein.

Figure 3:
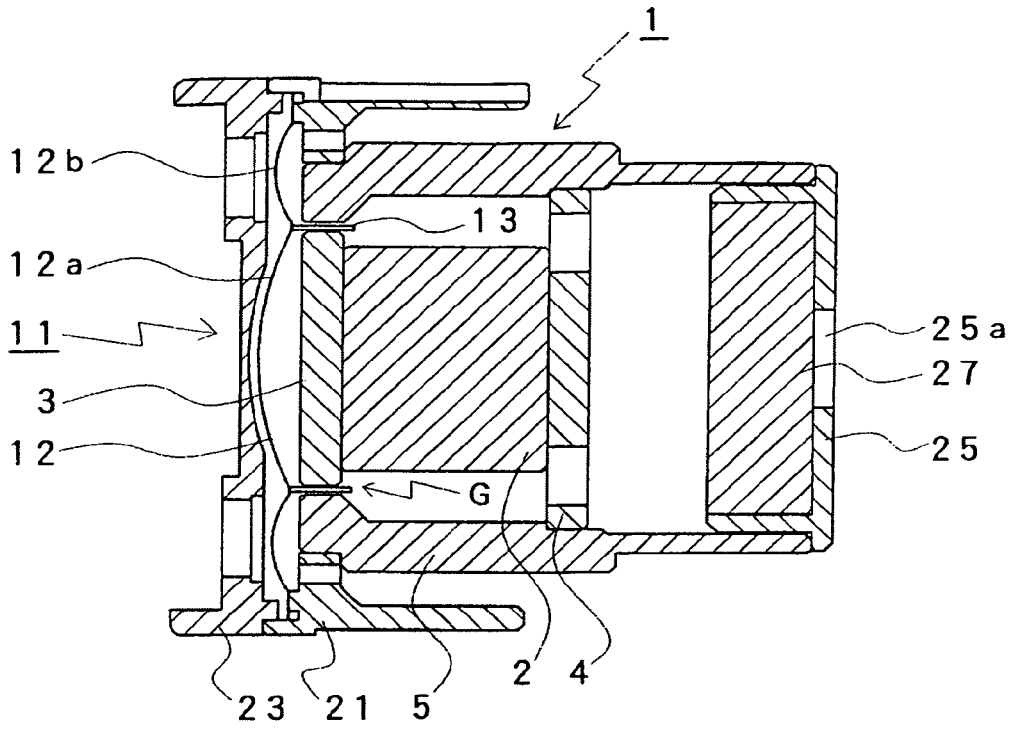
FIG. 3 is a sectional view showing an example of a conventional dynamic microphone.

In addition to the structure shown in and already described with reference to FIG. 3, a first permanent magnet 2 is in contact with one side of a tail yoke 4 and a second permanent magnet 6 is disposed on the other side (the opposite side) of the tail yoke in the dynamic microphone in accordance with the present invention shown in FIG. 1.

In other words, a first magnetic pole of the second permanent magnet 6 is disposed in contact with the tail yoke 4, a second polar piece 7 is further disposed in contact with a second magnetic pole of the above-mentioned second permanent magnet 6, and a magnetic path is produced between the above-mentioned second polar piece 7 and the cylindrically shaped yoke body 5.

In addition, the above-mentioned first permanent magnet 2 and the second permanent magnet 6 are polarized in the same sense.

Figure 2:
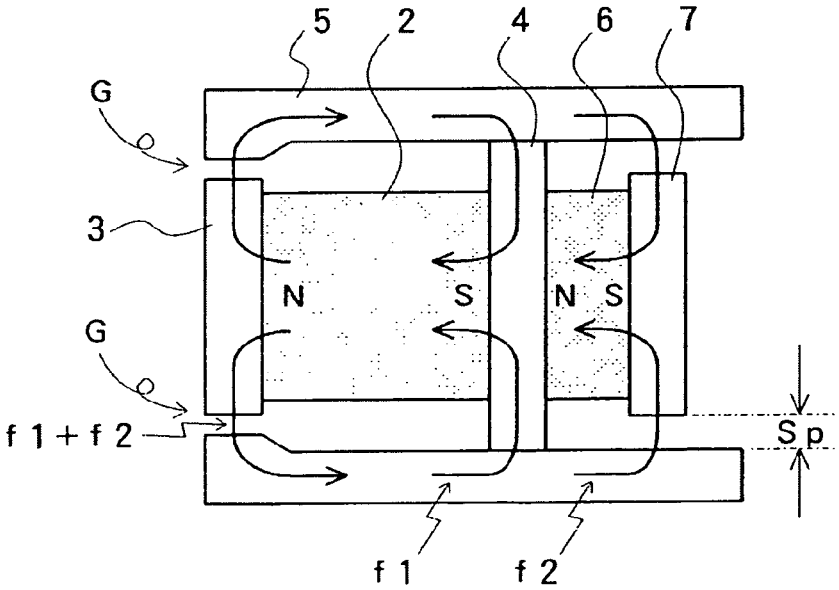
FIG. 2 is a schematic diagram for explaining the structure of the magnetic circuit of the dynamic microphone shown in FIG. 1.

FIG. 2 schematically shows main magnetic paths produced by the above-mentioned first permanent magnet 2 and the second permanent magnet 6.

In other words, in the case where the first magnetic pole in contact with the polar piece 3 (hereinafter also referred to as first polar piece) which forms the magnetic gap G in the first permanent magnet 2 is north (N) pole, then the second magnetic pole in contact with the tail yoke 4 in the first permanent magnet 2 is south (S) pole.

Further, since the above-mentioned first permanent magnet 2 and the second permanent magnet 6 are polarized in the same sense, the first magnetic pole which is in contact with the tail yoke 4 in the second permanent magnet 6 is north (N) pole, and the second magnetic pole which is in contact with the second polar piece 7 in the second permanent magnet 6 is south (S) pole.

According to the arrangement shown in FIG. 2, in the first permanent magnet 2, a closed magnetic circuit is formed through the first polar piece 3, the magnetic gap G, the cylindrical yoke body 5, and the tail yoke 4, and reference sign f1 indicates a magnetic flux in this closed magnetic circuit for convenience.

Further, in the second permanent magnet 2, a closed magnetic circuit is formed through the tail yoke 4, the first permanent magnet 2, the first polar piece 3, the magnetic gap G, the cylindrical yoke body 5, and the second polar piece, and reference sign f2 shows a magnetic flux in this closed magnetic circuit for convenience.

As can be seen from the schematic diagram shown in FIG. 2, the magnetic flux which passes through the above-mentioned magnetic gap G formed between the first polar piece 3 and the cylindrical yoke body 5 is a magnetic flux indicated by f1+f2 in which the magnetic flux f2 generated with the second permanent magnet 6 is added to the magnetic flux fl generated with the above-mentioned first permanent magnet 2.

According to this, the flux density in the magnetic gap G can be increased, so that the sensitivity of the microphone may be improved.

In this case, by suitably choosing a width of a space Sp between the cylindrical yoke body 5 and the second polar piece 7 when designing, magnetic reluctance of the closed magnetic circuit formed by the second permanent magnet 6 can be adjusted. As a result, a value of the above-mentioned magnetic flux f2 can be adjusted when designing.

Therefore, for the first permanent magnet 2, by using the alnico magnet which contains cobalt and nickel as main materials, it is possible to contribute to the improvement in the sound quality of the microphone due to properties of the alnico magnet. For the second permanent magnet 6, by using the neodymium magnet which contains neodymium as a main material, its properties (such as small size, large magnetic energy) can be employed efficiently, and it is possible to contribute to the improvement in the sensitivity of the microphone.

Further, since the first permanent magnet 2 and the second permanent magnet 6 are polarized in the same sense as described above, the problem that the first permanent magnet 2 made of alnico is demagnetized by the second permanent magnet 6 made of neodymium, for example, can be avoided. Thus, the operational effects described in "Effects of the Invention" can be obtained.

Figure 1:
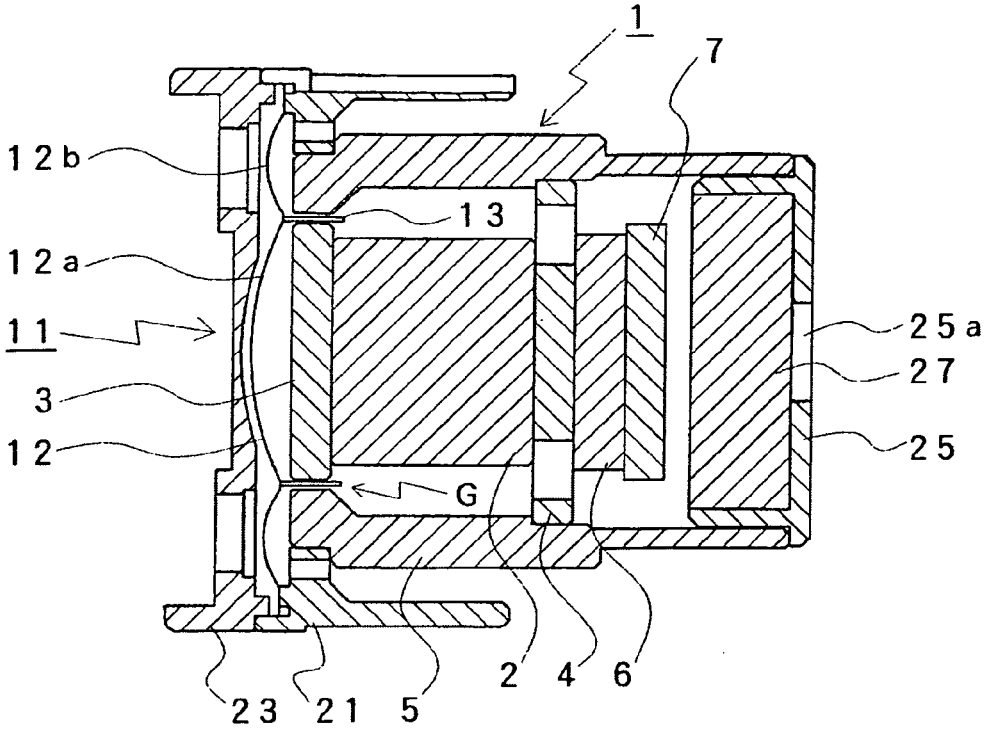
FIG. 1 is a sectional view showing a structure of a dynamic microphone in accordance with the present invention.
Figure 4:
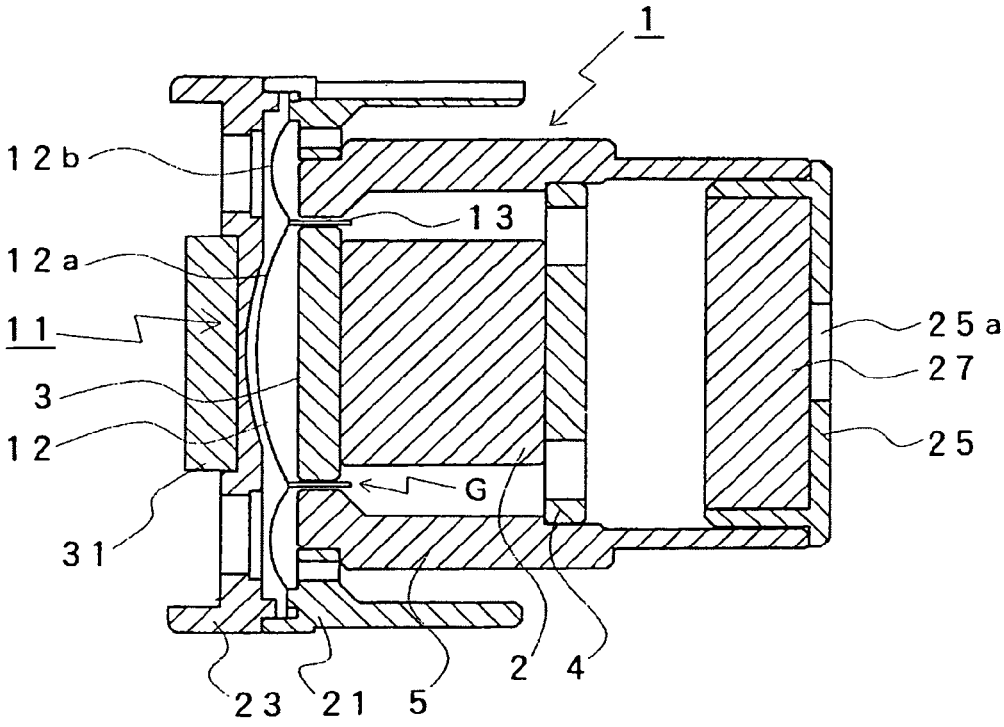
FIG. 4 is a sectional view showing an example of another conventional dynamic microphone whose sensitivity is improved.

Furthermore, according to the structure of the microphone shown in FIG. 1 in accordance with the present invention, unlike the conventional microphone shown in FIG. 4 in which the sensitivity is devised for improvement, it is not necessary for the second permanent magnet to be disposed in front of the diaphragm. Thus, there is virtually no limit to the design of the resonator for improving high-frequency characteristics of the microphone, and it is possible to realize the dynamic microphone which is excellent in the high-frequency characteristics.

In addition, in the structure of the microphone shown in FIG. 1, the second polar piece 7 is disposed in contact with the second permanent magnet 6, but this second polar piece 7 may not be necessary. Even if this second polar piece 7 is omitted, it is possible to produce magnetic path between the second magnetic pole (south (S) pole) of the second permanent magnet 6 and the cylindrical yoke body 5, and the operational effects similar to those described above can be expected.

What is claimed is:

1. A dynamic microphone, comprising a polar piece which is in contact with a first magnetic pole of a first permanent magnet, a yoke body annularly arranged around said polar piece through a magnetic gap with a predetermined width, a magnetic circuit unit including a tail yoke which is connected to said yoke body and in contact with a second magnetic pole of said first permanent magnet, and a diaphragm unit provided with a voice coil arranged to vibrate in said magnetic gap, wherein the second magnetic pole of said first permanent magnet is in contact with one side of said tail yoke, a first magnetic pole of a second permanent magnet is disposed in contact with the other side of said tail yoke, and said first permanent magnet and said second permanent magnet are polarized in the same sense.

2. A dynamic microphone as claimed in claim 1, wherein a second polar piece is further disposed in contact with a second magnetic pole of said second permanent magnet.

3. A dynamic microphone as claimed in claim 2, wherein a magnetic path is produced between the second magnetic pole of said second permanent magnet and said yoke body through said second polar piece.

4. A dynamic microphone as claimed in claim 1, wherein said first permanent magnet and said second permanent magnet are made of different materials, and said first permanent magnet and said second permanent magnet are different in magnetic energy.

5. A dynamic microphone as claimed in claim 1, wherein an alnico magnet is used as said first permanent magnet and a neodymium magnet is used as said second permanent magnet.

6. A dynamic microphone as claimed in claim 2, wherein an alnico magnet is used as said first permanent magnet and a neodymium magnet is used as said second permanent magnet.

* * * * *